United States Patent [19]

Hallqvist

[11] Patent Number: 4,777,862

[45] Date of Patent: Oct. 18, 1988

[54] CARTRIDGE CASE EJECTORS IN AUTOMATIC GUNS

[75] Inventor: Sten Hallqvist, Karlskoga, Sweden

[73] Assignee: Nobel Corporate Services, Karlskoga, Sweden

[21] Appl. No.: 68,714

[22] Filed: Jun. 30, 1987

Related U.S. Application Data

[63] Continuation of Ser. No. 855,579, Apr. 25, 1986.

[30] Foreign Application Priority Data

Apr. 26, 1985 [SE] Sweden ..... 8502019

[51] Int. Cl.[4] ..... F41F 11/02

[52] U.S. Cl. ..... 89/24; 42/25

[58] Field of Search ..... 89/24, 4.2, 173, 186, 89/187.01; 42/25, 23, 24; 87/47

[56] References Cited

U.S. PATENT DOCUMENTS

| | | | |
|---|---|---|---|
| 633,949 | 9/1899 | Bleha | 42/23 |
| 1,310,879 | 7/1919 | Schneider | 89/4.2 |
| 2,366,840 | 1/1945 | Dobremysl | 89/24 |
| 2,410,116 | 10/1946 | Vickers | 89/47 |
| 2,779,242 | 1/1957 | Willhauck | 89/24 |
| 3,120,071 | 2/1964 | Pernini | 42/25 |
| 3,733,729 | 5/1973 | Baker | 42/23 |
| 4,040,196 | 8/1977 | Smith et al. | 42/23 |

FOREIGN PATENT DOCUMENTS

| | | | |
|---|---|---|---|
| 713862 | 11/1941 | Fed. Rep. of Germany . | |
| 458125 | 8/1968 | Switzerland | 42/23 |
| 2027160A | 2/1980 | United Kingdom . | |

*Primary Examiner*—Stephen C. Bentley
*Assistant Examiner*—Stephen Johnson
*Attorney, Agent, or Firm*—Pollock, Vande Sande & Priddy

[57] ABSTRACT

The disclosure relates to an automatic gun which employs case ejectors (1, 1') for realizing extraction and ejection of the cartridge case from a spent round. The case ejector is also utilized for arresting the breech block during the recoil of the weapon and holding the breech block in an open position so that ramming home of a new round (3') may be executed. The ejector is exposed to the round in process of being rammed home, which round, during its thrust towards the homed position in the barrel, entrains the ejector so that the breech block (2) is released and may execute its closing movement int. al. with the assistance of spring means placed under tension during the opening movement of the breech block. The ejector and the breech block are designed with cooperating arrest and abutment surfaces which take up portions of the kinetic energy of the round which is in the process of being rammed. A separate buffer device (5) is also connected to the ejector, by means of which device the above-mentioned retardation/cushioning may be amplified. By such an arrangement, the feeding and ramming speed of the gun may be increased without the risk that each respective round jolt against the rear face of the barrel and derange the breech block in its closing cycle. Such a derangement would occasion cease-fire.

4 Claims, 3 Drawing Sheets

CARTRIDGE CASE EJECTORS IN AUTOMATIC GUNS

This application is a continuation of application Ser. No. 855,579, filed Apr. 25, 1986.

TECHNICAL FIELD

The present invention relates to an improvement to case ejectors in automatic weapons in which the case ejector is, when a round is rammed, in engagement with the case of the round so that it, during the recoil attendant upon discharge of the round and in response to action by the breech block of the weapon, executes an ejection movement. The case ejector is also of the type which, after the ejection movement, assumes an arrest position for the breech block to make for retention of the breech block in the open position and thereby ramming of a new round. Moreover, the case ejector shall be exposable to the new round so that it accompanies the new round in its ramming cycle to rammed-home position from the above-mentioned arrest position, thereby releasing the breech block which, by spring action, is thereafter actuable to its closed position.

THE STATE OF THE ART

It is previously known in this art to provide case ejectors, or extractors as they are otherwise known, with the dual functions of case ejection and arrest of the breech block when the block has turned in its fully open position and is actuated towards its closed position by spring means which are placed under tension during the opening movement of the breech block. It is also known in the art to cause the case ejector to cooperate in or effectuate itself retardation/cushioning of a round in the process of being rammed, so that the round, in the ramming operation, does not jolt against the rear plane of the barrel and derange the closure of the breech block.

In the above-mentioned arrest position, the case ejector and the breech block abut against one another by the intermediary of surfaces which may be designed such that, when the case ejector releases the breech block, this latter is caused to execute a minor downward movement against the action of spring means and strike against an abutment surface on the case ejector. The kinetic energy thus transmitted to the breech block is taken up from the kinetic energy of the round and the impetus of the round is hereby cushioned. The abutment between the breech block and the case ejector entails that a torque is impressed on the latter which is counter-directed to the direction of movement of the round, with the result that the impetus of the round is further cushioned.

SUMMARY OF THE INVENTION

Technical Problem

With a view to increasing the rate of fire of the weapon as such, it is of considerable importance to be able to increase the feeding and ramming rate of the rounds of ammunition. In turn, this means that greater kinetic energy must be transmitted from the round in the process of being rammed home.

Solution

The primary object of the present invention is to propose an improvement which solves this and other problems. The novel improvement lies in connecting the case ejector to a buffer device which, by cooperation with the case ejector in its movement from the arrest position to the ramming position, takes up a portion of the kinetic energy of the round which is in the process of being rammed.

In one proposed embodiment of the present invention, use is made of a hydraulic buffer which is connected to the free end of the case ejector. In one embodiment, the buffer device consists of a hydraulic buffer with a piston whose piston rod is connected to a holder or bracket for the end of the case ejector. The buffer device is designed preferably so as to effectuate buffer action substantially in but a single direction, this being effected by means of, for example, a non-return valve function.

The present invention further proposes specific designs of the cooperating arrest surfaces and abutment surfaces of the case ejector and the breech block.

In one preferred embodiment of the present invention, the above-mentioned three different buffer functions and the impact of the round against the rear surface of the breech substantially take up equal portions of the kinetic energy which is to be dissipated from the round during its ramming cycle.

ADVANTAGES

According to the present invention, it will be possible to increase the feeding and ramming rate, and to dimension accurately the effectuated buffer effect on a rammed-home round, so that jolts against the rear plane of the barrel will be avoided during the ramming operation.

The above-mentioned arrest and abutment surfaces may be of optimum design from the point of view of wear, which increases the working life of the parts involved.

BRIEF DESCRIPTION OF THE ACCOMPANYING DRAWINGS

The nature of the present invention and its aspects will be more readily understood from the following brief description of the accompanying drawings, and discussion, referring thereto, of the significant parts of one preferred embodiment of an improvement according to the present invention.

In the accompanying drawings:

FIG. 1 shows in side elevation and partial section an ejector (extractor) in its two end positions and together with buffer means; and FIGS. 2 to 5 illustrate, in side elevation, the functional principle of case ejector and breech block in an automatic weapon.

DESCRIPTION OF PREFERRED EMBODIMENT

The present invention may be applied to such pieces of artillery as, for example, the BOFORS AK 40/L 70 automatic gun. Hence, the present invention will be described only in relation to those parts of this prior art gun which are directly germane to the present invention.

Figure 1:
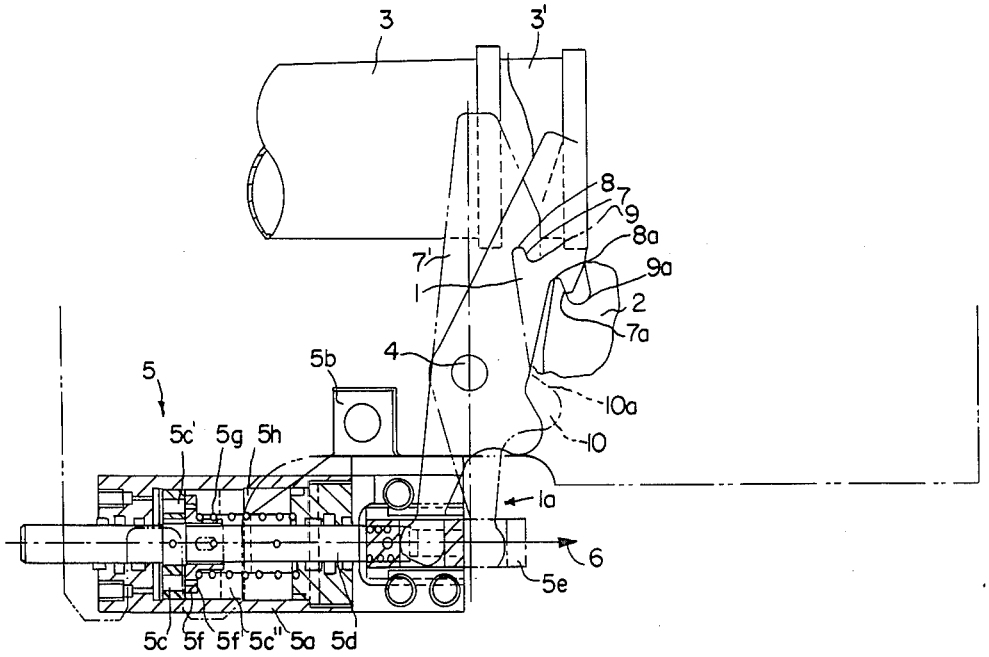

Referring to the drawings, FIG. 1 shows an ejector, by means of a solid line 1, in an arrest position for a breech block 2 (partially illustrated in the drawing) and, by means of a ghosted line 1', in a ramming position for a round 3 (partially shown on the drawing). The round is shown by reference numeral 3 in a rammed-home position in the chamber of the gun, at which position the round has arrived by means of a feeding and ramming cycle. The round is also shown in a position 3' in the ramming path.

The ejector is pivotally journalled in or with a shaft 4. The ejector is allotted the two distinct end positions by the breech block 2 which, in its opening movement, strikes over the ejector from the position 1' to the position 1, and by the round 3' in the process of being rammed, which entrains the ejector from the arrest position 1 to the position 1', and so on. A weapon of the type contemplated here is normally fitted with two ejectors.

At its free end, the ejector/ejectors cooperate with a buffer device 5 which is provided to effectuate cushioning of each respective ejector on its movement from the position 1 to the position 1'. The buffer device is arranged so as not to exercise any buffer function—or at any rate but slight buffer function—on movement of the ejector from the position 1' to the position 1, this movement being the ejection movement proper, under which the ejector withdraws the cartridge case from the chamber and ejects the case rearwardly. This buffer function may be realised by means of a non-return valve function.

The buffer device displays a cylinder 5*a* which is provided with an anchorage 5*b* by means of which the buffer device may be anchored at a suitable place in the breech of the weapon and in immediate association with the case ejector. The buffer device is further provided with a piston 5*c* and piston rod 5*d*. At the end of the piston rod, there is provided a journal 5*e* for the end 1*a* of the ejector.

A further piston 5*f* is disposed on the upper side of the piston 5*c* and is movably journalled on the piston rod and discrete from the piston 5*c*. A spring 5*g* strives to urge the piston 5*f* towards the upper surface of the piston 5*c*.

The pistons 5*c* and 5*f* have through passages 5*c*' and 5*f*', respectively, between the upper and lower surfaces of the pistons. The total cross-sectional area of the passages 5*c*' considerably exceeds the total cross-sectional area of the passages 5*f*'. The piston 5*f* extends above the passages 5*c*', but leaves clear play in relation to the inner wall of the cylinders 5*a*. The working cavity 5*h* of the cylinder accommodates a liquid medium, for example glycol.

Actuation of the piston rod from the starting position according to FIG. 1 in the direction of the arrow 6 via the ejector entails that the piston 5*f* is held urged against the upper surface of the piston 5*c*. The passages 5*f*' determine the throttling of the liquid passage from the upper sides of the pistons to the lower sides of the pistons. As a result of this throttling, movement in the ejector will be cushioned. This entails in its turn that a retardation force will be impressed upon the round 3' in its ramming cycle.

The extraction position obtained for the piston rod and the piston 5*c* is represented in FIG. 1 by broken lines 5*c*'' for the piston. When the ejector moves from the position 1' to the position 1, media on the underside of the piston 5*c* forces the piston 5*f* from the piston 5*c*, with the result that the larger passages 5*c*' are voided, which in turn entails slight, or no, buffer force on the ejector in this direction of movement.

The ejector is designed with arrest surfaces 7, 8 and 9 which cooperate with corresponding surfaces 7*a*, 8*a*, and 9*a*, respectively, on the breech block. The surfaces 7 and 7*a* are substantially straight, while the surfaces 8 and 9*a* are curved, for example arcuate. The surfaces 9 and 8*a* are substantially straight, but are angled in relation to the surfaces 7 and 7*a*. The surfaces on the ejector form an undercut which extends above a corresponding shoulder on the breech block.

The ejector is designed with a further shoulder 10 which is provided with an inclined surface 10*a*. The inclined surface may cooperate with a corresponding abutment surface 11 (see FIG. 2) on the breech block.

The buffer device 5, the surfaces 7, 8, 9, 7*a*, 8*a*, 9*a* and the surfaces 10*a*, 11, respectively provide a coordinated cushioning function for the round 3' which is in the process of being rammed. Since a portion of the kinetic energy inherent in the round is transmitted to the ejector and the breech block, the round may be gently cushioned in its thrust towards the homing position even though it moves at a relatively high ramming speed. The impact of the round (the case flange) against the rear plane of the barrel may thus be limited so that jolts are avoided. The high ramming speed can be utilized for increasing the rate of fire.

Figure 2:
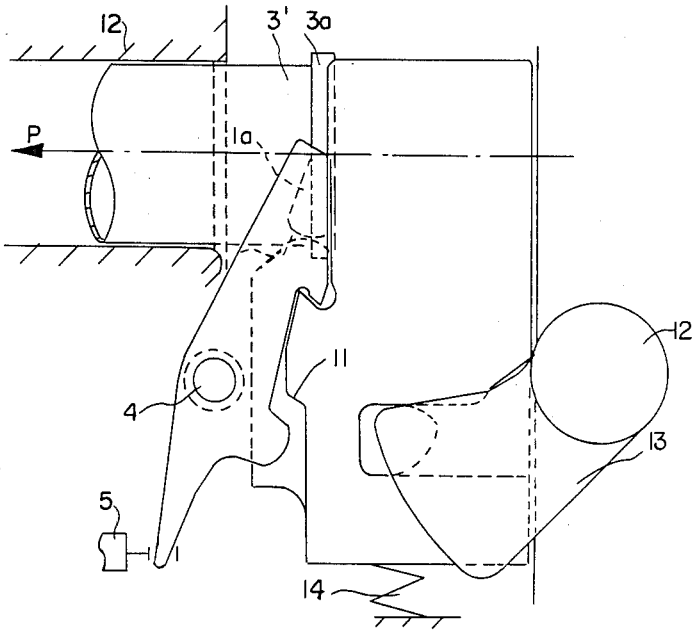
Figure 3:
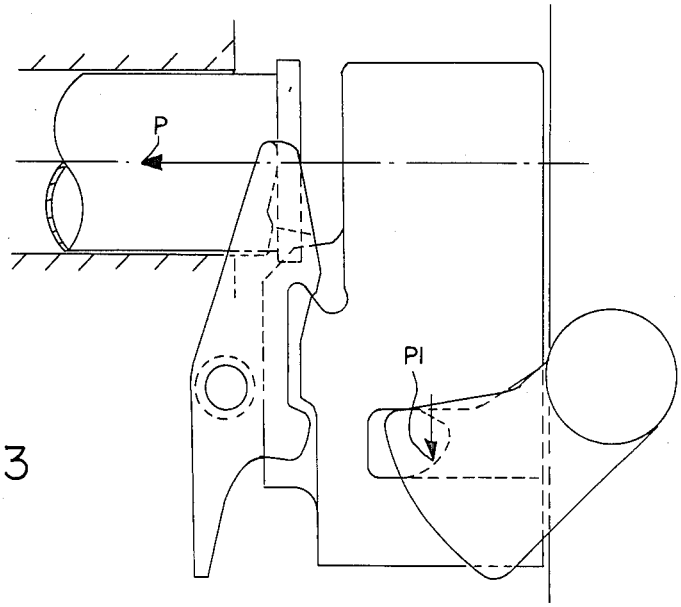

FIGS. 2–5 show mutually subsequent functional positions for the ejector and the breech block. An operating shaft 12 transmits the motion of the breech to the breech block by a torque movement which is obtained from an operating cam (not shown). This movement transmission to the breech block is effected by means of linkage arms 13, of which only one is shown on the drawings. FIG. 2 illustrates the arrested position of the breech block. The round 3' is underway in the direction of the arrow P. The case flange 3*a* enters into engagement with surfaces 1*a* exposed to the flange 3*a*, with the result that the case ejector beings to pivot about the shaft 4. As a result of the undercutting of the arrest surfaces, a downward movement is imparted to the breech block from the closure position, in the direction of the arrow P1 (FIG. 3). The kinetic energy of the breech block is obtained from the kinetic energy of the round.

Figure 4:
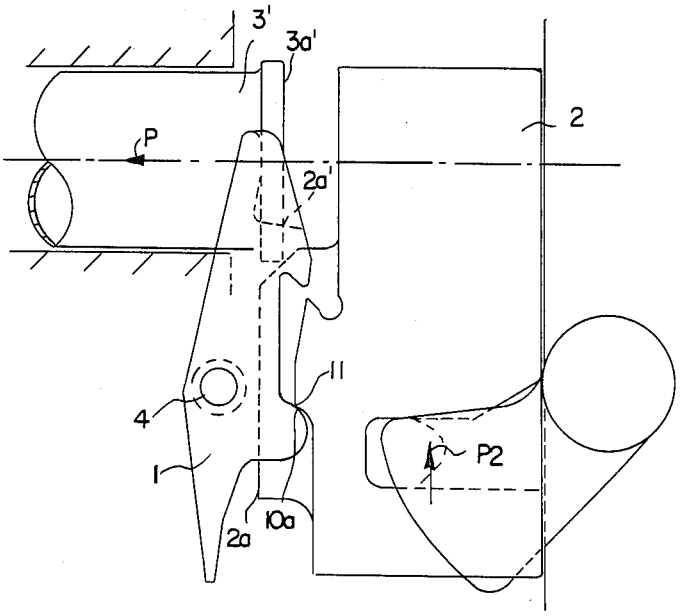
Figure 5:
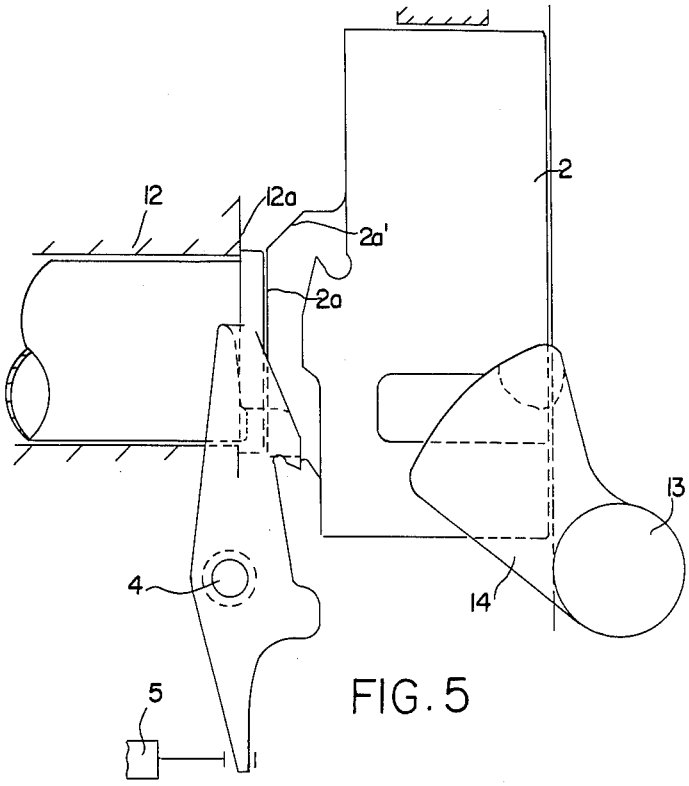

At a predetermined relative position between the breech block 2 and the case ejector 1 according to FIG. 4, the abutment surface 11 of the breech block strikes against the abutment surface 10*a* of the case ejector. This entails that a movement is imparted to the breech block towards its closure position according to the arrow P2. The abutment impact also entails that a torque is imparted to the case ejector about the shaft 4 which is counter-directed to the movement P of the round, this being further cushioned in its thrust.

The spring member 14 (FIG. 2) assists in the continued movement of the breech block towards the closure position. At this point, the arrest surfaces on the ejector and breech block disengage. The sealing surface 2*a* of the breech block is urged upwardly behind the rear face 3*a*' of the case 3.

A chamfer 2*a*' facilitates entry of the surface 2*a* behind the surface 3*a*'. The case strikes the rear plane 12*a* of the barrel 12 with the remaining, uncushioned kinetic energy, according to FIG. 5, which shows the fully closed position.

The buffer device 5, the arrest surfaces 7–9 and 7*a*–9*a*, respectively, the abutment surfaces 10*a*, 11, and the impact of the round against the rear plane 12*a* are preferably arranged so as to take up substantially equal portions of the total kinetic energy of the round.

The above-described ejector normally works with an identical ejector which is correspondingly disposed at the breech block and ramming path in the gun. In such an instance, both of the ejectors may be provided each with their buffer device 5. It is possible to allow the two ejectors to work against a common, separate buffer device. In such a provision, each respective ejector is connected to the common buffer device by the intermediary of the anchorage 5*e*.

The present invention should not be considered as restricted to the embodiment described above by way of example, and shown on the drawings, many modifications being conceivable without departing from the spirit and scope of the appended claims or the inventive concept as herein disclosed.

What we claim and desire to secure by Letters Patent is:

1. In an automatic weapon a device for increasing feeding and ramming rate of a round comprising:

a case ejector moveable between an arrest position and a ramming postion, a breech block actuable between an open and closed position, said case ejector being actuated for ejection movement from said ramming position to said arrest position by said breech block and from said arrest position to said ramming position by a new round during its ramming cycle to the rammed home position, said breech block being retained in an open position by said case ejector in said arrest position, thereby facilitating feeding and ramming of a new round, said breech block being releasable from its open position by movement of said case ejector toward said ramming position, spring means for returning said breech block into its closed position, and a buffer device connected to said case ejector, wherein said case ejector is pivotally mounted about a shaft member which extends substantially through the middle part of said ejector, said ejector having a first end interactable with said round and a second end interactable with said buffer device, said case ejector being rotatable by said new round in counterclockwise direction, said case ejector including a hook member and a retardation portion, said hook member extending downwardly above the shaft member, and said retardation portion extending downwardly below the shaft member, said breech block including a corresponding upwardly extending portion having surfaces co-acting with surfaces on said hook member for pressing said breech block onward against said spring member when said case ejector is rotated in said counterclockwise direction by said new round thereby performing a first damping function, said breech block in its downward motion impacting said retardation portion, said retardation portion counteracting with said counterclockwise motion of the case ejector whereby constituting a second damping function, and said buffer device effecting third damping function on said case ejector while it is moving in said counterclockwise direction from said arrest position to said ramming position and wherein said buffer device comprises a hydraulic buffer including a piston disposed in a liquid-filled cavity, said piston being provided with passages extending between its upper and lower ends.

2. A device as claimed in claim 1 wherein said case ejector cooperates with said buffer device through an intermediary member located at said case ejectors second end.

3. A device as claimed in claim 2 wherein said buffer device has a non-return valve function.

4. A device as claimed in claim 1 wherein said buffer device, said hook member surfaces co-acting with the corresponding surfaces of said breech block and said retardation portion absorb substantially equal portions of the kinetic energy of the round.

* * * * *